US006988472B2

(12) United States Patent
Takahashi et al.

(10) Patent No.: US 6,988,472 B2
(45) Date of Patent: Jan. 24, 2006

(54) CONTROL DEVICE AND CONTROL PROGRAM PRODUCT FOR ENGINE

(75) Inventors: Kazutoshi Takahashi, Hamamatsu (JP); Isato Taki, Hamamatsu (JP); Takahiro Suzuki, Hamamatsu (JP); Minoru Murakami, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 10/849,632

(22) Filed: May 18, 2004

(65) Prior Publication Data

US 2004/0244748 A1 Dec. 9, 2004

(30) Foreign Application Priority Data

Jun. 3, 2003 (JP) ..... 2003-158431

(51) Int. Cl.
*F01L 1/34* (2006.01)

(52) U.S. Cl. ..... 123/90.15; 123/90.16; 123/90.17

(58) Field of Classification Search ..... 123/90.15, 123/90.16, 90.31, 90.17
See application file for complete search history.

(56) References Cited

U.S. PATENT DOCUMENTS 6,109,225 A * 8/2000 Ogita et al. ..... 123/90.15
6,330,870 B1 * 12/2001 Inoue et al. ..... 123/90.17
6,415,753 B1 * 7/2002 Nagaosa et al. ..... 123/90.18
6,575,128 B2 * 6/2003 Nakamura et al. ..... 123/90.16
6,581,566 B2 * 6/2003 Oishi ..... 123/306

FOREIGN PATENT DOCUMENTS

JP 04-187807 A1 7/1992

OTHER PUBLICATIONS

Patent Abstracts of Japan for JP04-187807 published on Jul. 6, 1992.

* cited by examiner

*Primary Examiner*—Thomas Denion
*Assistant Examiner*—Zelalem Eshete
(74) *Attorney, Agent, or Firm*—Darby & Darby

(57) ABSTRACT

An engine unit includes a valve driving mechanism in which a cam having its cam profile axially varying continuously is slid along the axis of the cam shaft to control continuously a lift characteristic of an intake valve to be steplessly variable. In the control device of the engine, when the engine is, determined to be in a idling state by an idling-state determining unit, a target cam position is obtained according to a target valve lift amount calculated based on the cooling water temperature by a target cam position calculated unit, and the target cam position is corrected according to atmospheric pressure, an engine oil temperature, an ATF temperature, and an intake temperature, so that an engine rotation will be stabilized in the idling state.

13 Claims, 12 Drawing Sheets

FIG. 5A
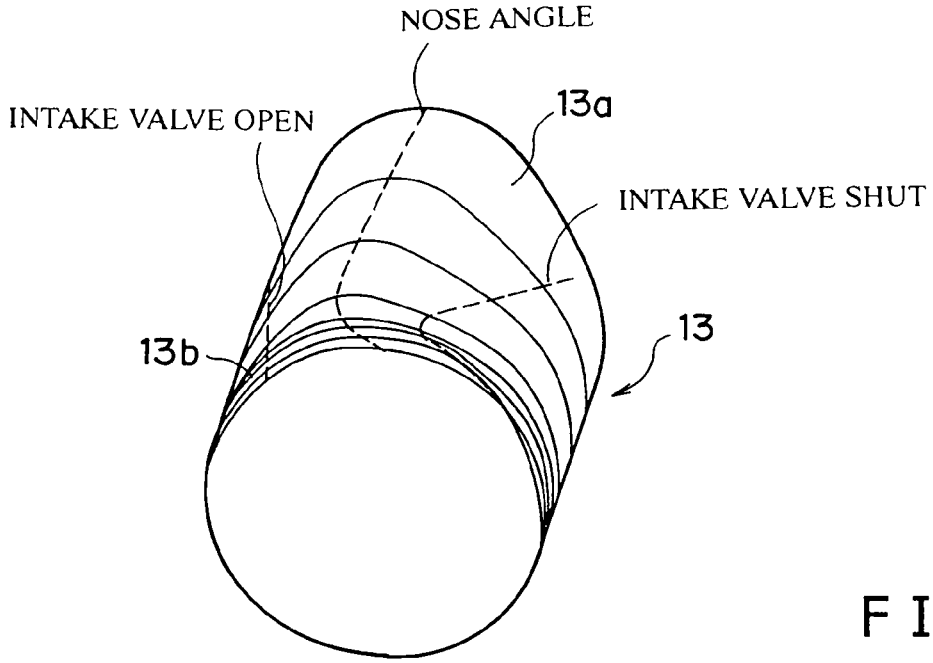
FIG. 5C
FIG. 5B
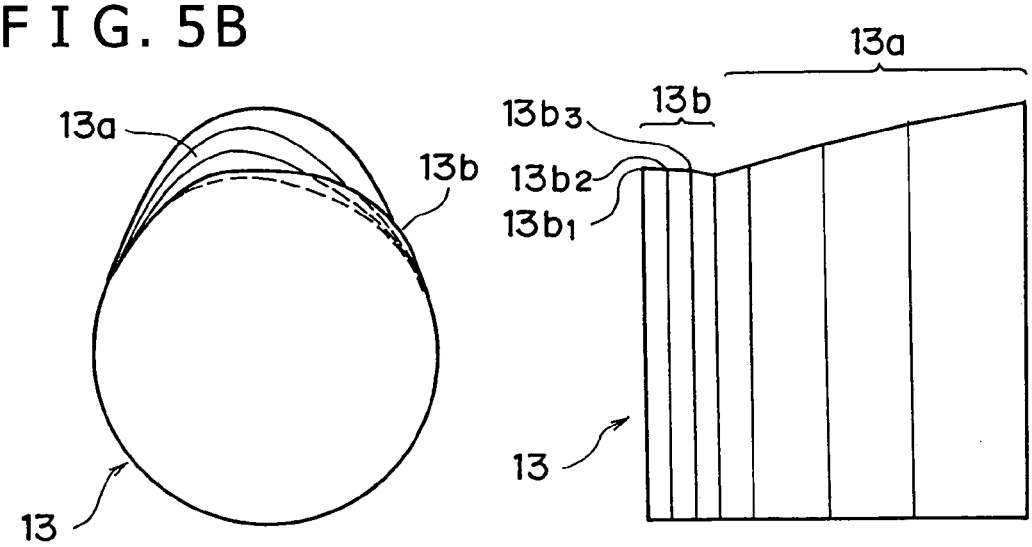

CONTROL DEVICE AND CONTROL PROGRAM PRODUCT FOR ENGINE

CROSS-REFERENCE TO RELATED APPLICATIONS

This application is based upon and claims the benefit of priority from the prior Japanese Patent Application No. 2003-158431, filed on Jun. 3, 2003, the entire contents of which are incorporated herein by reference.

BACKGROUND OF THE INVENTION

1. Field of the Invention

The present invention relates to a control device and a control program product for an engine used in a motorcycle or an automobile, particularly the present invention is suitable for applying to an engine having a valve driving mechanism in which a cam having its cam profile axially varying continuously is slid along the axis of the cam shaft so as to control continuously a valve lift characteristic to be steplessly variable.

2. Description of the Related Art

As a valve driving mechanism provided to an engine, there discloses in Japanese Patent Application Laid-open No. 4-187807, for example, an art of a valve driving mechanism in which a cam having its cam profile axially varying continuously is slid along the axis of the cam shaft so as to control continuously a lift amount and lift timing of an intake valve or an exhaust valve to be steplessly variable.

When such a cam is applied to the intake valve especially, by continuously varying a lift characteristic of the intake valve to be steplessly variable, an intake air amount can be controlled, so that an intake resistance can be reduced, removing the throttle valve of an intake path. As a result, an engine output can be increased.

By setting the cam profile so as to the intake valve will shut early in a low load range of engine, an air-fuel mixture is expanded adiabatically after the intake valve is shut, and further, compressed adiabatically. Owing to this expansion, an intake temperature falls, and the intake temperature just before the ignition also falls to be lower than the case that the valve is shut late. Thereby, a knocking is prevented, at the same time, an expansion ratio can be maintained high, so that the heat efficiency can be improved by a miller cycle engine in which the expansion ratio is higher than a compressed ratio.

If the lift amount itself is reduced, a mechanical loss can also be reduced, as a result, the good fuel economy can be obtained.

In this type of valve driving mechanism, the lift amount is determined according to an opening-degree of accelerator and an engine speed so as to control the sliding of a cam. When the engine runs in an idling state, namely, in a state the accelerator is shut down completely, the intake air amount fluctuates due to some conditions, there exists the fears that an engine rotation is revved up fast and adversely stalled.

When the feedback control of a cam position is performed only for controlling the air amount, the delay for moving the cam position incurs a hunting of engine rotation.

In this type of valve driving mechanism, the increasing condition of engine temperature is lower than the condition of an engine having the commonly used two-dimensional cam, therefore, a temperature regulation is important for preventing deterioration of exhaust gas, or for improving the engine output.

If an intake pipe simply leaving out the generally-used throttle valve etc. which controls through the whole range of engine rotation is provided to the engine, the air-fuel mixture especially in the small intake amount may not be sufficiently obtained.

SUMMARY OF THE INVENTION

In view of the above, the present invention has its object to provide an engine having a valve driving mechanism for controlling continuously the valve lift characteristic to be steplessly variable by sliding a cam, intending the stabilization of engine rotation mainly in the idling state.

The control device for the engine of the present invention is a control device for an engine having a valve driving mechanism in which a cam having its cam profile axially varying continuously is slid along the axis of the cam shaft so as to control continuously a lift characteristic of a valve to be steplessly variable, comprises a target cam position calculating unit for calculating the target cam position based on the engine temperature condition, and correcting the target cam position according to the other information, and a control unit for sliding the cam, controlling a cam position moving unit for sliding the cam.

A control program product of the present invention is a control program product for controlling an engine having a valve driving mechanism in which a cam having its cam profile axially varying continuously is slid along the axis of the cam shaft so as to control continuously a valve lift characteristic to be steplessly variable, and make a computer execute a processing for calculating a target cam position based on the engine temperature condition, a processing for correcting the target cam position according to the other information, and a processing for sliding the cam by controlling a cam position moving unit for sliding the cam.

BRIEF DESCRIPTION OF THE DRAWINGS

FIG. 5A is a perspective view of a cam 13;

FIG. 5B is a plan view of the cam 13;

FIG. 5C is a side view of the cam 13;

DETAILED DESCRIPTION OF THE PREFERRED EMBODIMENTS

Figure 1:
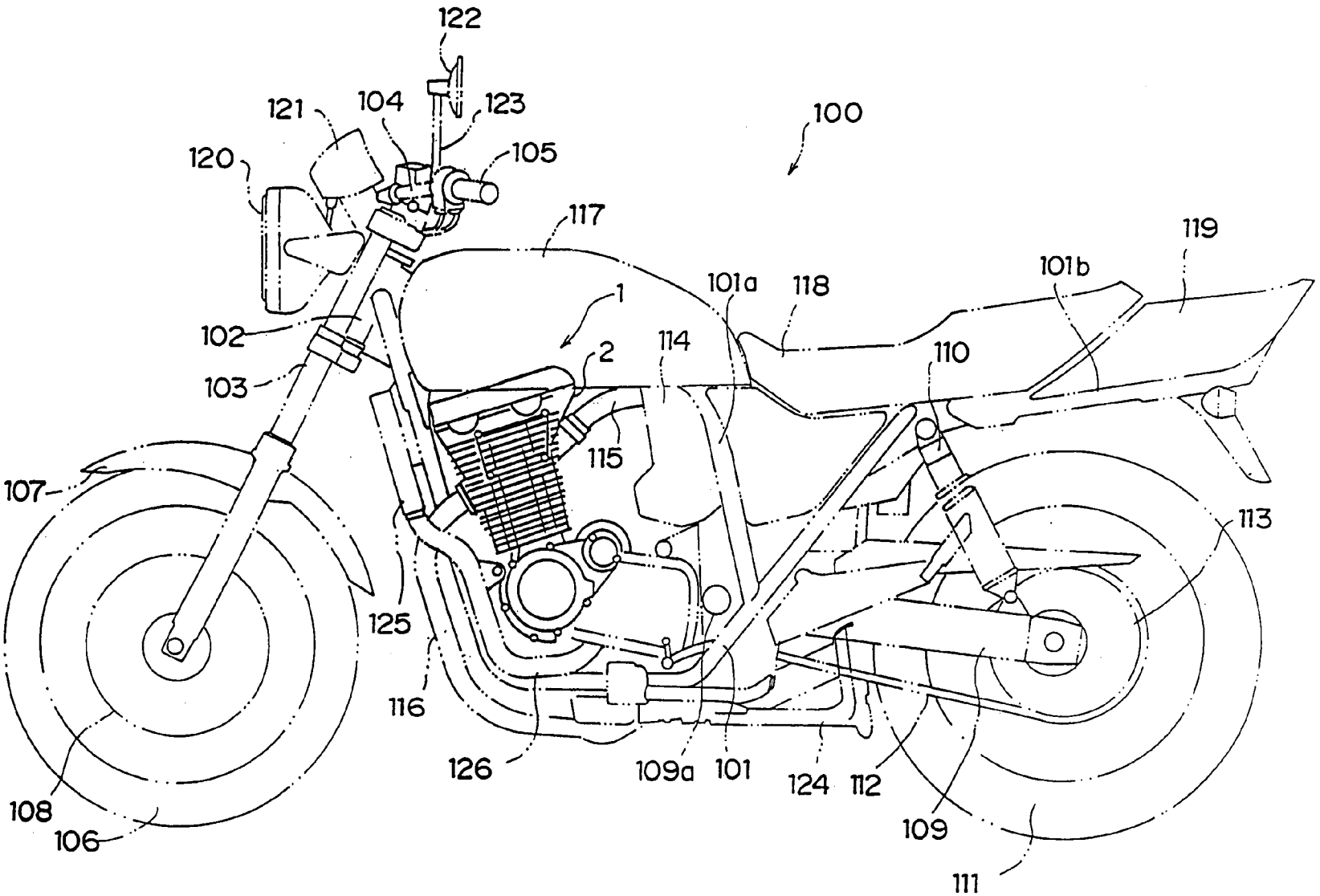
FIG. 1 is a view showing a constitution example of a motorcycle including an engine and its peripheral part according to an application example of the present invention.

Hereinafter, a preferred embodiment according to the present invention will be described based on the drawings. In the present embodiment, an example of calculating a target cam position based on the cooling water temperature in an idling engine will be given. A control device for an engine according to the present invention is efficiently applicable to various types of gasoline engines used in motorcycles or automobiles. In this embodiment, a motorcycle engine, as shown in FIG. 1, is taken as an example.

First, the entire structure of a motorcycle 100 concerning the present embodiment will be described. In FIG. 1, two front forks 103 supported rotatably clockwise and counterclockwise by a steering head pipe 102 are provided at the front of a vehicle body frame 101 made of steel or aluminum alloy material. A handle bar 104 is fixed to the top of the front forks 103, and is equipped with grips 105 at both ends.

A front wheel 106 is rotatively supported at the lower part of the front forks 103. A front fender 107 is fixed to cover an upper portion of the front wheel 106. The front wheel 106 has a brake disc 108 which rotates integrally with the front wheel 106.

A swing arm 109 is swingably provided at the rear of the vehicle body frame 101, and a rear shock absorber 110 is mounted between the vehicle body frame 101 and the swing arm 109. At the rear end of the swing arm 109, a rear wheel 111 is rotatively supported, and driven rotationally via a driven sprocket 113 with a chain 112 wound around it.

To an engine unit 1 loaded on the vehicle body frame 101, an air-fuel mixture is supplied from an intake pipe 115 connected to an air cleaner 114, and exhaust gas after combustion is released through an exhaust pipe 116. The air cleaner 114 is placed in a space large enough to allow for proper functioning behind the engine unit 1, under a fuel tank 117 and a seat 118. Consequently, the intake pipe 115 is connected to the rear side of the engine unit, and the exhaust pipe 116 is connected to the front side of the engine unit 1. The fuel tank 117 is loaded over the engine unit, and the seat 118 and a seat cowl 119 are provided connectively behind the fuel tank 117.

Furthermore, in FIG. 1, reference numeral 120 denotes a head lamp, reference numeral 121 denotes a meter unit including a speed-meter, a tachometer, various kinds of indicator lamps and the like, and the reference numeral 122 denotes a rearview mirror supported by the handle bar 104 via a stay 123. A center stand 124 is swingably attached to the lower part of the vehicle body frame 101, which allows the rear wheel 111 to be placed in contact with the ground or lifted from the ground.

The vehicle body frame 101 is provided to extend downward diagonally toward the rear from the head pipe 102 provided at the front, and after it is bent to wrap a portion under the engine unit 1, it forms a pivot 109*a* for supporting the axle of the swing arm 109, and connects to a tank rail 101*a* and a seat rail 101*b*. This vehicle body frame 101 is provided with a radiator 125 in parallel with the vehicle body frame to avoid interference with the front fender 107, and a cooling water hose 126 is placed along the vehicle body frame 101 from the radiator 125 and communicates with the engine unit 1 without interfering with the exhaust pipe 116.

Figure 2:
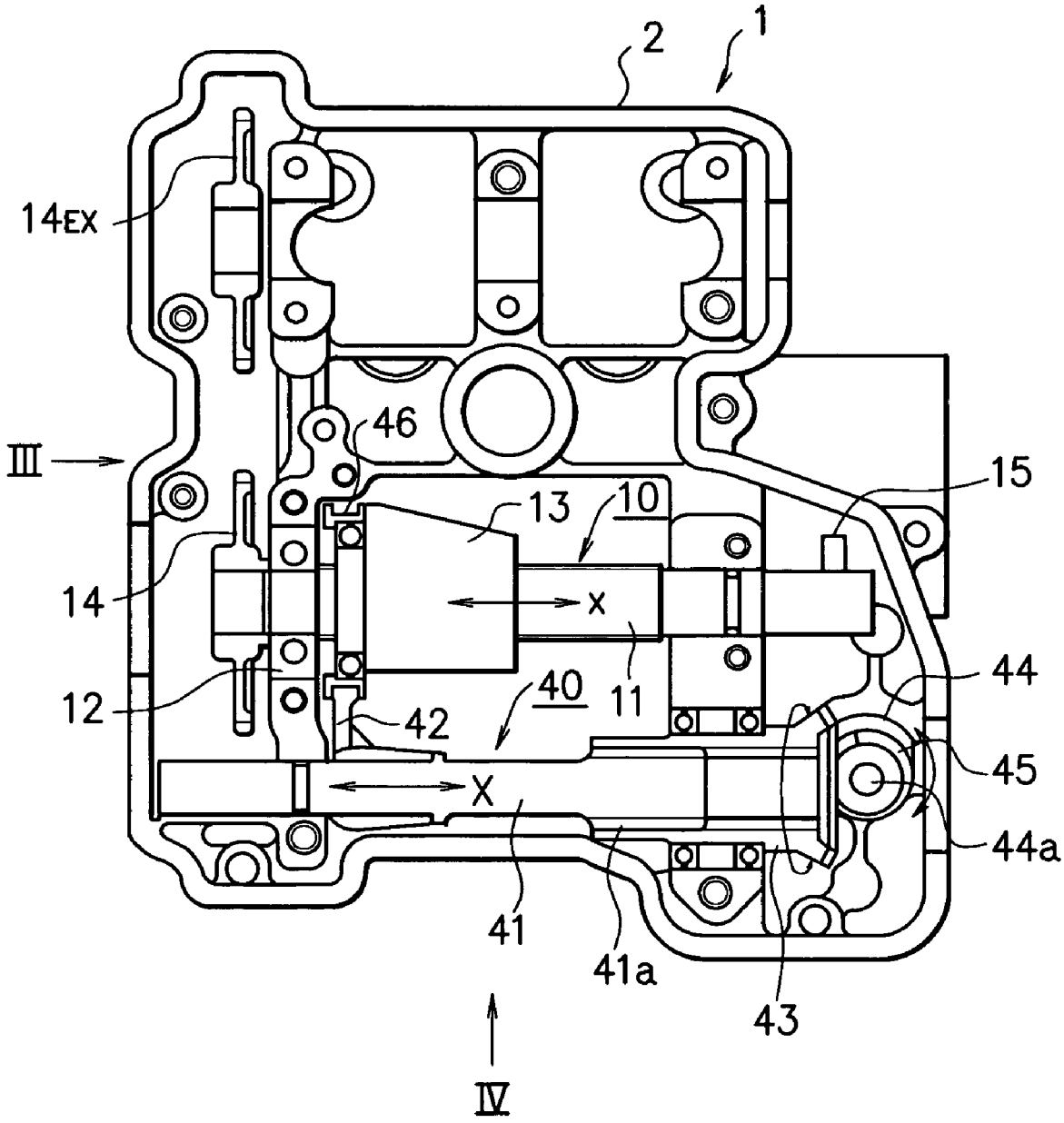
FIG. 2 is a partially sectional plan view showing an essential part of a valve driving mechanism.
Figure 3:
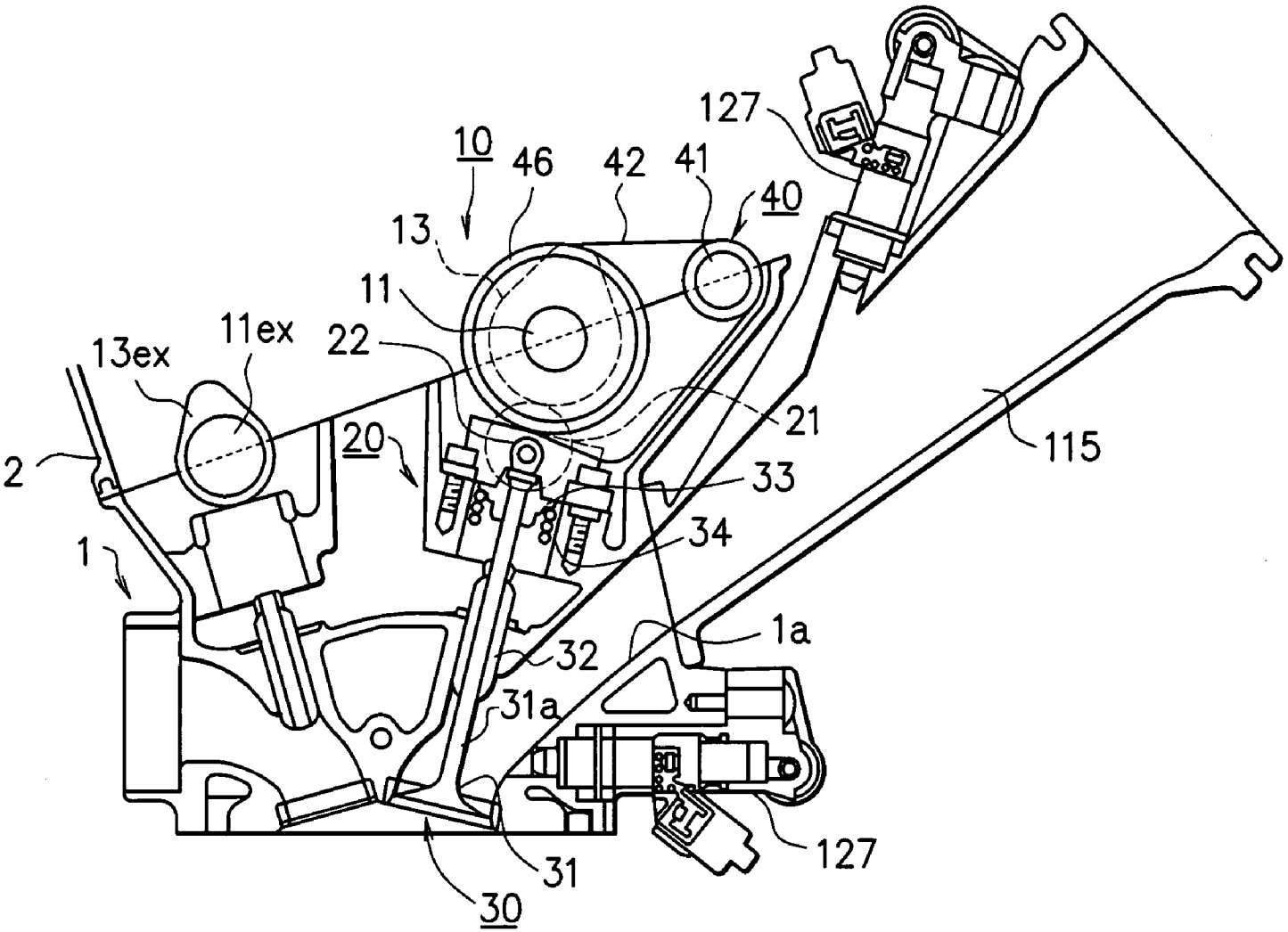
FIG. 3 is a partially sectional side view (arrow III direction of FIG. 2) showing an essential part of the valve driving mechanism.
Figure 4:
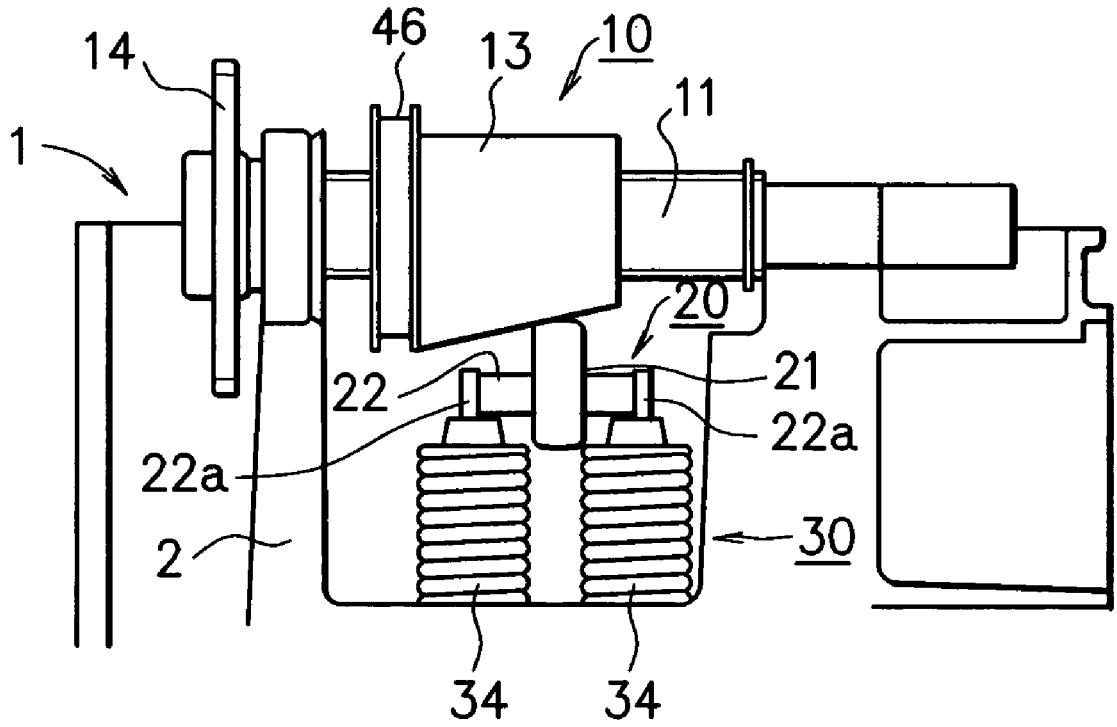
FIG. 4 is a partially sectional side view (arrow IV direction of FIG. 2) showing an essential part of the valve driving mechanism.

FIG. 2 to FIG. 4 are views showing a relevant part of a valve driving mechanism of the engine unit 1. A piston reciprocated up and down inside a cylinder, and the valve driving mechanism is housed in a cylinder head 2 placed at an upper portion at the piston.

In the present embodiment, on an intake side, there provides the valve driving mechanism in which a cam profile allows a cam axially varying continuously to slide along the axis of the cam shaft so as to control continuously a valve lift characteristic to be steplessly variable. On the intake side, the valve driving mechanism includes a cam/camshaft unit 10, a tappet unit 20 placed on the lower side of the cam/camshaft 10, a valve unit 30 for performing intake control, and an acceleration shaft unit 40 for sliding a cam 13 of the cam/camshaft unit 10.

In the cam/camshaft unit on the intake side, a camshaft 11 is placed and rotatively supported via a bearing 12 as shown in FIG. 2 and FIG. 4. A sprocket 14 is fixed to one end of the camshaft 11. A cam chain is provided to wind around the sprocket 14 on the intake side, a sprocket $\mathbf{14}_{EX}$ similarly fixed to one end of a camshaft $\mathbf{11}_{EX}$ (refer to FIG. 3) on an exhaust side, and a drive sprocket fixed to one end of a crank shaft not shown. Note that a phase of the cam is detected via a pin 15 attached to the camshaft 11. Also, an engine speed is detected by an engine speed sensor equipped to a magneto on the crankshaft not shown.

The cam 13 is slidably attached to the camshaft 11 along the axis thereof. A spline allowing balls to lie between, for example, the camshaft 11 and the cam 13 is formed, so that a relative rotation between the cam 13 and the camshaft 11 is controlled, and the cam 13 linearly moves [linear motion] (arrow "x" in FIG. 2). The cam 13 is designed as a three-dimensional, curved-surface-shaped cam (hereinafter, it is called "three-dimensional cam"). The cam 13 of which cam profile continuously varies in a longitudinal direction (axial direction of the camshaft 11) slides along the camshaft 11, so that it controls a lift amount and lift timing of an intake valve to be continuously and steplessly variable. Note that a cam position is detected, through not concretely shown.

The tappet unit 20 on the intake side, as shown in FIG. 4, includes a tappet roller 21 of which outer peripheral face is spherical, the peripheral face being contacted with the cam 13. Inside the tappet roller 21, an arm member 22 is placed, which has a core adjusting function for making the tappet roller 21 possible to rotate normally, even when the arm member 22 inclines to the tappet roller 21. Pressing portions 22*a* are provided to both ends of the arm member 22 abutting on a valve retainer 33 in the valve unit 30 described later.

In the valve unit 30 on the intake side, as shown in FIG. 3, a valve stem 31*a* includes an intake valve 31 guided by a valve guide 32. When the intake valve 31 lifts, the mixture of air led from the air cleaner 114 and fuel sprayed from an injector 127 is introduced into a combustion chamber. The valve retainer 33 is provided to the end of each valve stem 31*a* and a biasing force of valve springs 34 works on the valve retainer 33.

The acceleration shaft unit 40 on the intake side includes, as shown in FIG. 2, an acceleration shaft 41 placed next to the camshaft 11 in parallel, and an acceleration fork 42 fixed to the acceleration shaft 41 and connected to the cam 13.

The acceleration shaft 41 is moveably supported in the axial direction, of which one end is screwed to a driven gear 43 via a feed screw 41*a*. A drive gear 45 provided to an output shaft 44*a* of an acceleration motor 44 is screwed to the driven gear 43. Consequently, a rotational motion of the acceleration motor 44 is transformed into a linear motion via the feed screw 41*a*, so that the acceleration shaft 41 can be moved axially (arrow "X" in FIG. 2).

The acceleration fork 42 extends to the side of the camshaft 11 perpendicularly to the acceleration shaft 41, and includes tip end portions having a bifurcated shape. A fork guide 46 is provided to the end of the cam 13 and engaged with the bifurcated tip end portions of the acceleration fork 42. Consequently, the cam 13 slides along the camshaft 11 interlocked with or synchronized with the acceleration shaft 41 sliding axially.

Meanwhile, on the exhaust side, the three-dimensional cam is not applied, the lift amount and lift timing of an exhaust valve are controlled according to a cam $\mathbf{13}_{EX}$ which has a constant profile fixed to the camshaft $\mathbf{11}_{EX}$. Note that only component parts on the intake side are shown in FIG. 2 to FIG. 4, the component parts on the exhaust side are not entirely shown.

In the valve driving mechanism constituted as described above, when an accelerator grip (or an accelerator pedal) is operated, the acceleration motor 44 is actuated under a control of a control device 50 described later, and the acceleration shaft 41 moves axially by rotation of its output shaft 44*a*. Consequently, the cam 13 slides along the camshaft 11 interlocked with the movement of the acceleration shaft 41 via the acceleration fork 42. Note that the variable control by the three-dimensional cam may not only be performed on the intake side as in this embodiment, but may also be performed on the exhaust side.

By controlling an intake amount in the way described above, the optimal intake and exhaust for the engine speed can be realized. For example, at a low engine speed, the tappet roller 21 abuts on the cam at a lower region in cam height. When acceleration is made in this state, namely, when the accelerator is opened, the acceleration shaft 41 moves axially, rightward in FIG. 2 by the actuation of the acceleration motor 44. The cam 13 also slides rightward in FIG. 2 along the camshaft 11, interlocked with the movement of the acceleration shaft 41 via the acceleration fork 42. The tappet roller 21 gradually abuts on a higher region of the cam height by sliding of the cam 13, whereby the valve lift amount increases. Meanwhile, at a time of deceleration, by returning the accelerator, the valve lift amount is decreased in the reverse operation from the above description.

Hereinafter, one example for the cam 13 on the intake side will be given with reference to FIG. 5A to FIG. 5C. As shown in FIG. 5A to FIG. 5C, the cam 13 includes a principal cam surface 13*a* of which cam profile varies continuously corresponding to the range from low engine speed to high engine speed. And there provides an idling-state cam surface 13*b* formed so as to lift the intake valve 13 at a small amount in a later stage of the intake process.

Figure 6:
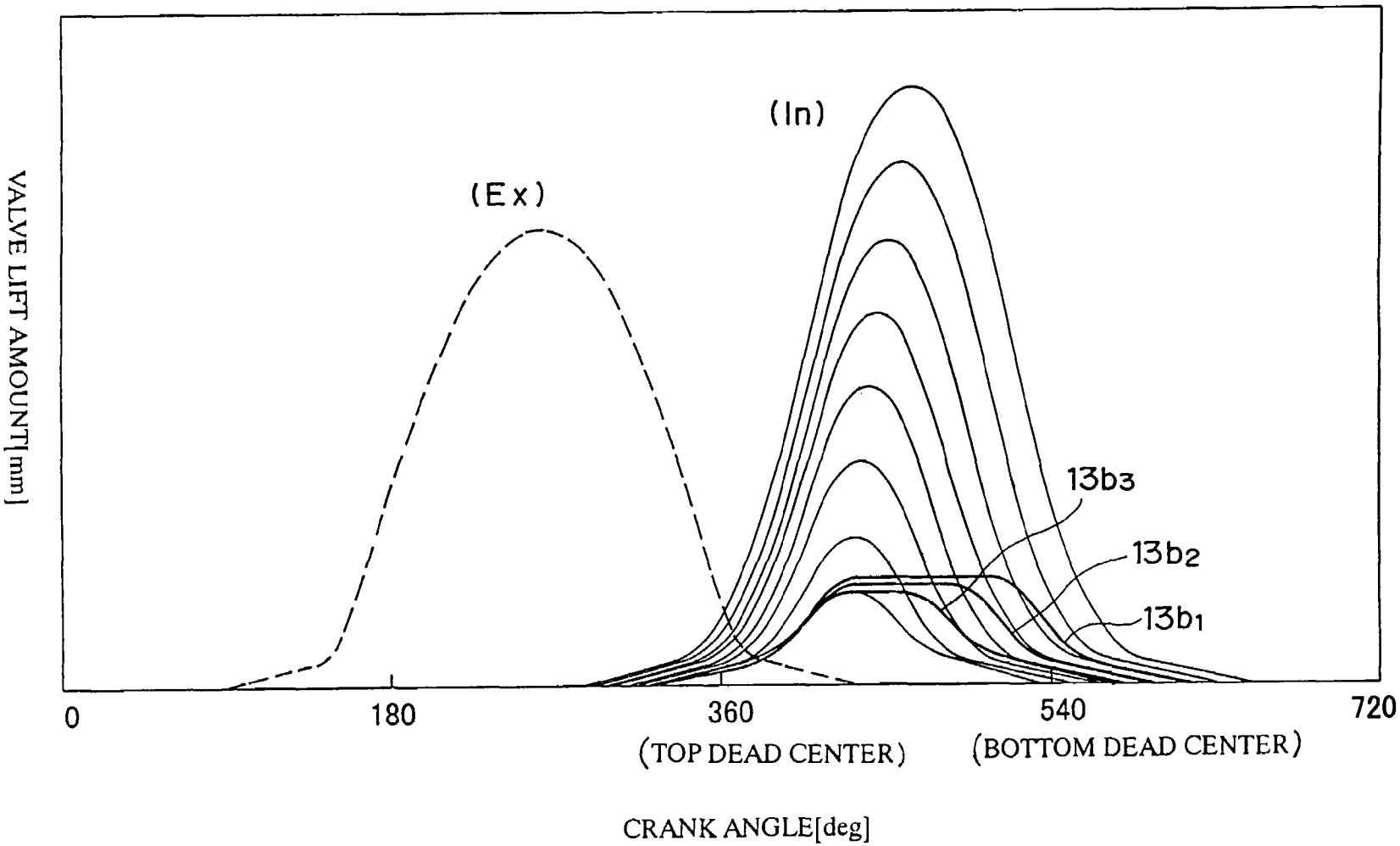
FIG. 6 is a view showing concrete example of a constitutional factors of the cam 13 as a three-dimensional cam.

In FIG. 6, a concrete example of constitutional factors of the cam 13 as a three-dimensional cam is shown. The principal surface 13*a* of the cam 13 is set so as to become high in cam height in accordance with the engine speed range becoming high. Such a cam 13 is slid along the cam shaft 11, so that the lift amount and lift timing of the intake valve 31 are controlled steplessly to be continuously variable.

The idling-state cam surface 13*b* is set to be almost the same height as, or higher than the height of the principal cam surface 13*a*, including a first cam portion $\mathbf{13}b_1$, a second cam portion $\mathbf{13}b_2$, and a third cam portion $\mathbf{13}b_3$. The cam heights are set in increasing order from cam portion $\mathbf{13}b_3$ to cam portion $\mathbf{13}b_1$ as shown in valve lift curves in FIG. 6. And the timing for shutting the intake valve 31 are set in order from cam portion $\mathbf{13}b_3$ to cam portion $\mathbf{13}b_1$.

Figure 7:
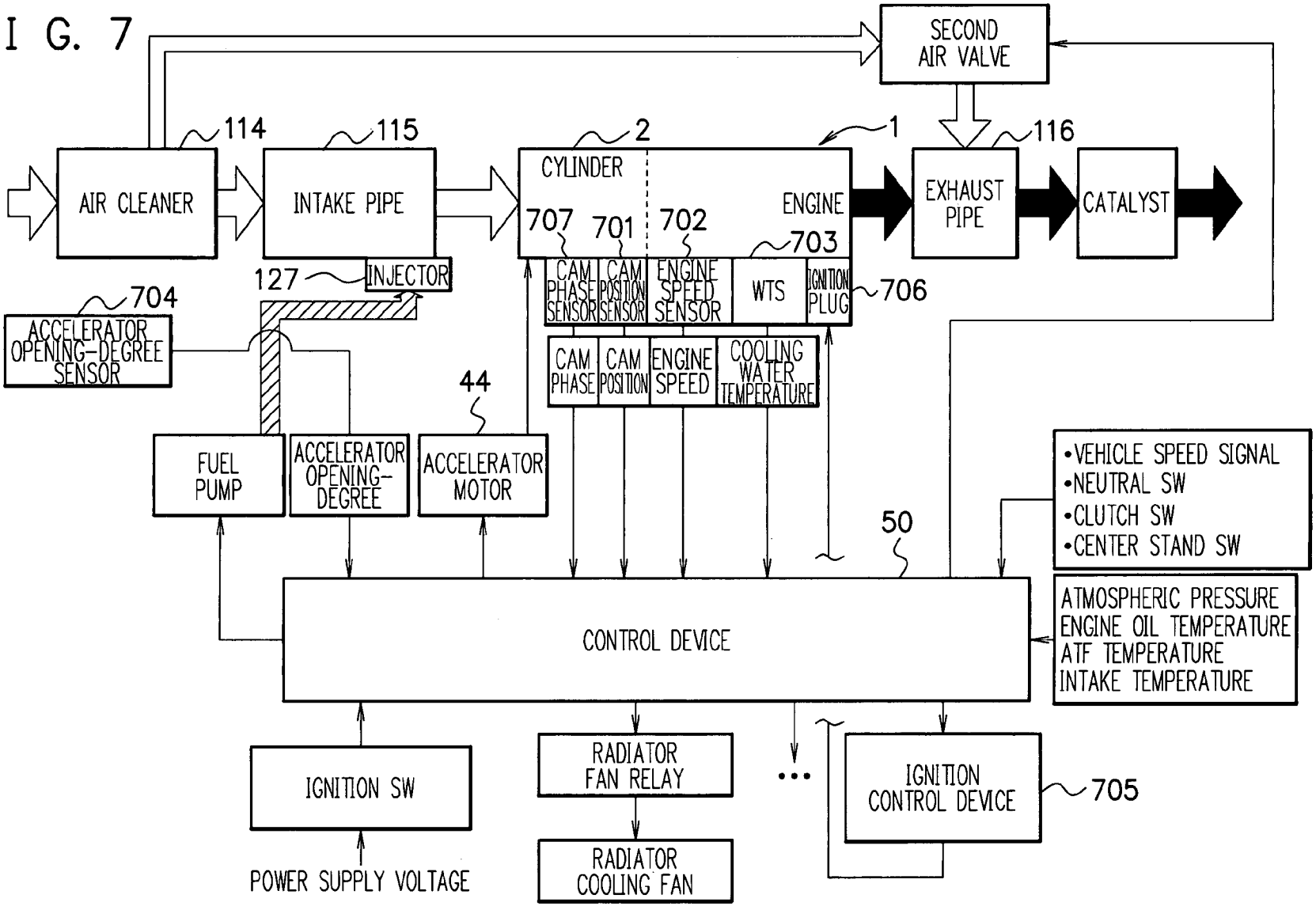
FIG. 7 is a view showing a peripheral constitution of a control device 50.

The peripheral constitution of the control device for controlling engine is shown in FIG. 7. The component parts already described are explained with the same numeral being put thereto. The mixture of air led from the air cleaner 114 via the intake pipe 115 and fuel sprayed from the injector 127 is supplied into the engine unit 1, the exhaust gas after combustion is released through the exhaust pipe 116.

In periphery of the engine unit 1, a cam position sensor 701 for detecting the cam position, an engine speed sensor 702 for detecting the engine speed, a water temperature sensor (WTS) 703 for detecting the temperature of cooling water circulating in an water jacket in the engine unit 1, and a cam phase sensor 707 for detecting the cam phase are provided, and these detected signals are inputted into the control device 50. Further, an atmospheric pressure signal, a engine oil temperature signal, a signal for the temperature of automatic transmission fluid (ATF), an intake temperature signal are inputted into the control device 50 from respective sensors not shown.

In periphery of the accelerator grip, an accelerator opening-degree sensor 704 is provided and a detected signal thereof is inputted into the control device 50.

Besides, a vehicle speed signal from a vehicle speed sensor, a neutral switch signal for indicating whether a transmission is in a neutral position or not from a gear position sensor, a clutch switch signal for indicating whether the clutch is disconnected or not from a clutch input sensor, and a center stand switch signal for indicating whether the center stand is in use or not from the center stand side are inputted into the control device 50 respectively.

Based on the cam position signal, the engine speed signal, the cooling water temperature signal, the atmospheric pressure signal, the engine oil temperature signal, the ATF temperature signal, the intake temperature signal, the accelerator opening-degree signal, the vehicle speed signal, the neutral switch signal, the clutch switch signal, and the center stand switch signal inputted as described above, the control device 50 controls the acceleration motor 44 so as to make the cam 13 slide, and adjust an ignition timing by an ignition plug 706 via an ignition control device 705 when necessary.

As shown in FIG. 3, the injector (fuel spray device) 127 is provided so as to direct to a downstream side of an intake port 1*a* of the cylinder head 2 or the downstream side of the intake pipe 115, so that the control device 50 controls the injector to spray the fuel balanced with the intake amount. Especially, when the injector 127 is provided on the downstream side of the intake port 1*a* of the cylinder head 2, the fuel is sprayed with being directed to the periphery of an umbrella portion of the intake valve 31, so that a cross-sectional area of the flow path in the intake pipe is limited to be small. Thereby, the fuel can be injected at the only position where the flow speed of air is highest, as a result, sufficiently mixed air-fuel mixture can be introduced to the combustion chamber at any intake amount and the fuel efficiency is stabilized. The injector (fuel spray device) 127 provided on the intake pipe 115 in the upper stream side to direct to the downstream side may be provided both on the upstream side and the downstream side. And when plural intake valves 31 are provided and loads of respective valve springs thereof are varied, the injector 127 can be provided shifting towards the intake valve having a smaller valve spring load. In FIG. 3, the acceleration shaft 41 etc., and the injector (fuel spray device) 127 are gathered on both sides, sandwiching the port 1*a*, and the cylinder head is downsized, so that degrees of freedom is given to the arrangement of the intake pipe air cleaner.

Figure 8:
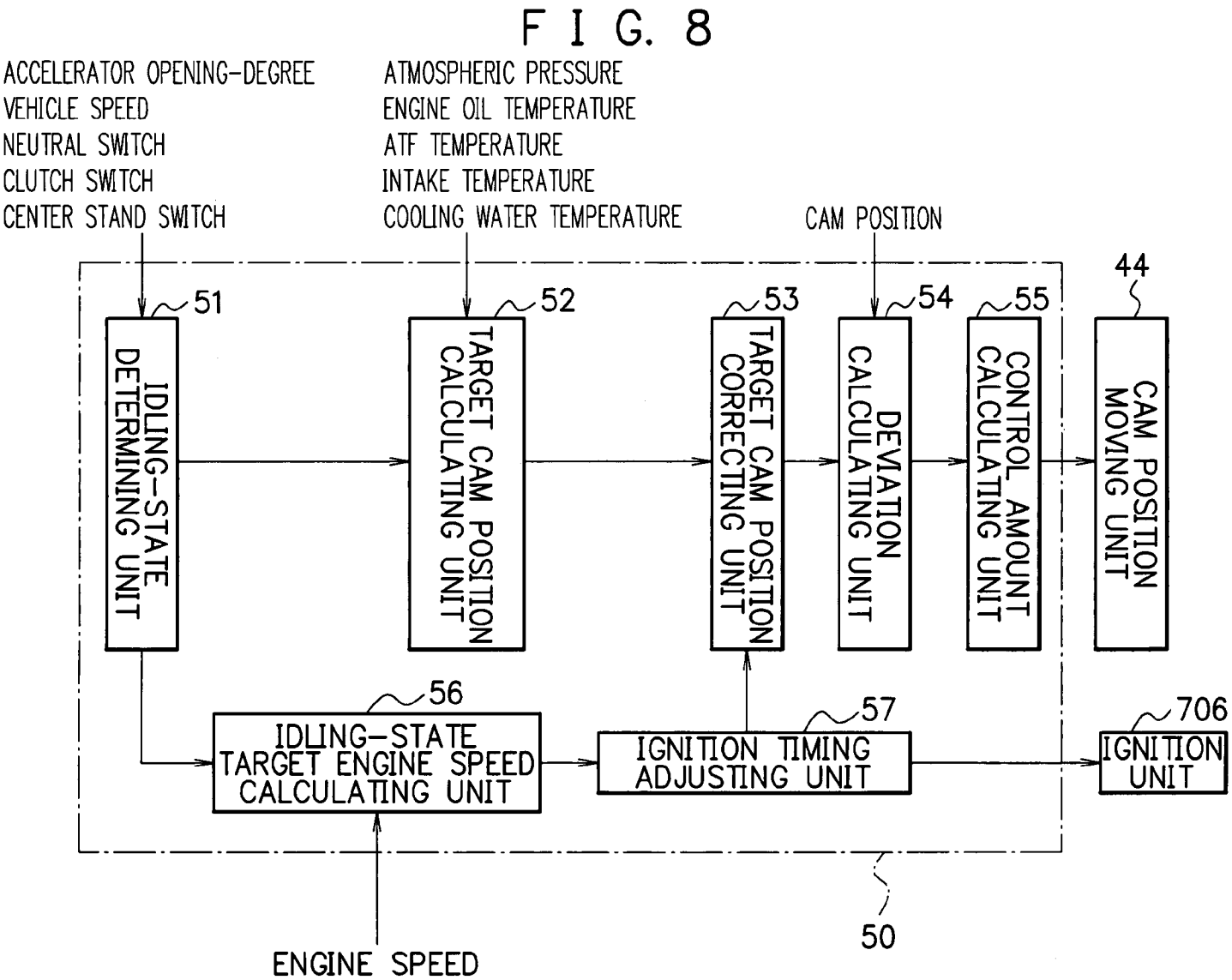
FIG. 8 is a block diagram showing a functional constitution of the control device 50.

FIG. 8 is a block diagram showing a functional constitution of the control device 50. In this drawing, reference numeral 51 denotes an idling-state determining unit for determining whether the engine unit 1 runs in idling state or not. And reference numeral 52 denotes a target cam position calculating unit for calculating the target cam position according to the target valve lift amount calculated from the cooling water temperature, and correcting the target cam position according to the atmospheric pressure, the engine oil temperature, the ATF temperature, the intake temperature, when the engine unit 1 is determined to be in the idling state by the idling-state determining unit 51.

Further, reference numeral 56 denotes an idling-state target engine speed calculating unit for determining whether there exists a difference exceeding an acceptable range between the target engine speed and the actual engine speed or not, when the engine unit 1 is determined to be in the idling state by the idling-state determining unit 51. Reference numeral 57 is an ignition timing adjusting unit for making an advanced angle adjustment or a delayed angle adjustment for an ignition timing by controlling the ignition unit (ignition plug) 706, when the idling-state target engine speed calculating unit 56 determines that there exists an unacceptable range of difference between the target engine speed and the actual engine speed.

Reference numeral 53 denotes a target cam position correcting unit. In the case that an advanced angle amount or a delayed angle amount required for the advanced angle adjustment or the delayed angle adjustment for the ignition timing by the ignition timing adjusting unit 57 is beyond the predetermined limited amount, the target cam position correcting unit 53 corrects the target cam position calculated by the target cam position calculating unit 52 in the idling state, without making an advanced angle adjustment or a delayed angle adjustment for the ignition timing.

Reference numeral 54 denotes a deviation calculating unit 54 for calculating the deviation between the target cam position finally determined and the actual cam position. Reference numeral 55 denotes a control amount calculating unit for calculating the control amount of feedback corresponding to the deviation between the finally determined target cam position and the actual cam position to make the cam slide to the target cam position by controlling the cam position moving unit (acceleration motor) 44.

Hereinafter, control by the control device 50 will be explained in detail in reference to flow charts of FIG. 9 to FIG. 12.

Figure 9:
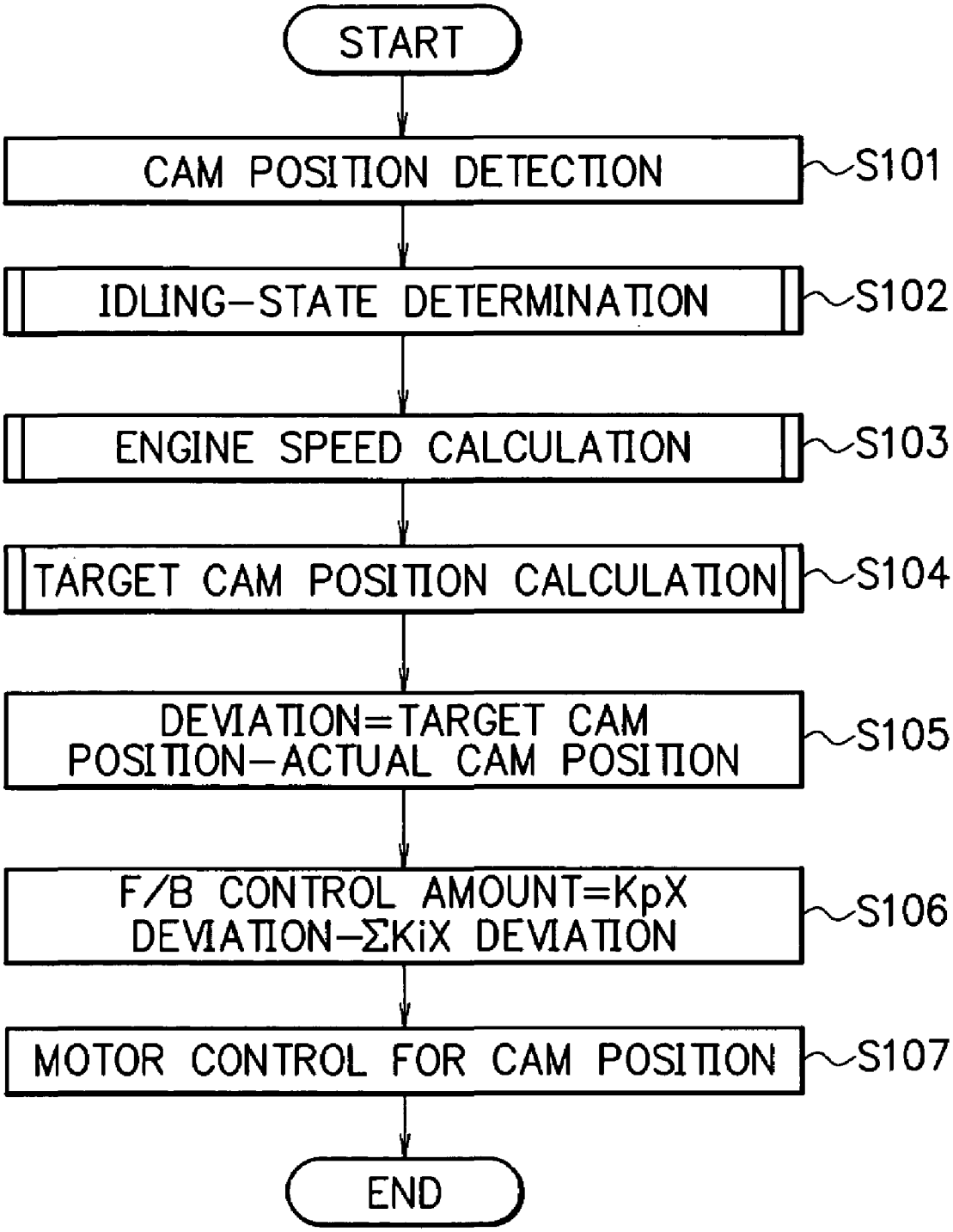
FIG. 9 is a flow chart for explaining a processing operation in the control device 50.

FIG. 9 is a flow chart showing a processing operation in the control device 50, and the operation is executed repeatedly in a predetermined cycle. First, the actual cam position is detected by the cam position sensor 701 (step "S101"). Next, whether the engine runs in the idling state or not is determined by the idling-state determining unit 51, as shown in a flow chart of FIG. 11 (step "S102").

Figure 11:
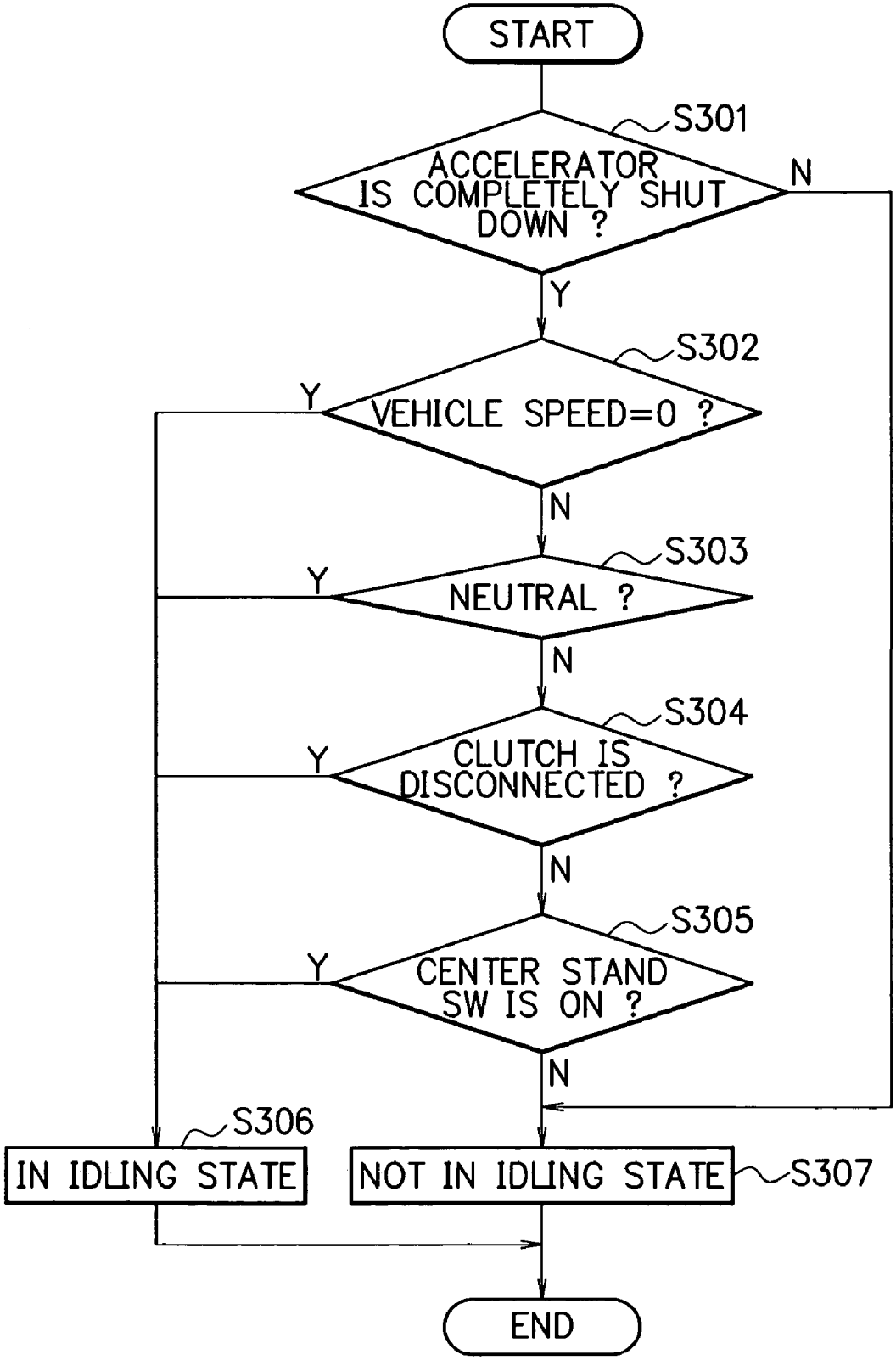
FIG. 11 is a flow chart for explaining an idling-state determination processing.

In FIG. 11, a flow chart of processing for determining the idling state in detail in the above described step "S102". As shown in FIG. 11, whether an accelerator is completely shut down or not is determined by the accelerator opening-degree sensor 704 (step "S301"). If the accelerator does not shut down completely, the sensor determines that the engine is not in the idling state (step "S307"). Meanwhile, if the accelerator is completely shut down, the sensor determines whether vehicle speed is "0(zero)" [i.e. vehicle is stopped] (step "S302"), whether a transmission is in neutral position (step "S303"), whether a clutch is disconnected (step "S304"), and whether a center stand is in use (step "S305"). If all conditions are denied, the engine is determined not to be in the idling state (step "S307"), and if any condition is met, the engine is determined to be in the idling state (step "S306").

To return to the explanation of the flow chart in FIG. 9, as a next step, an actual engine speed NE is calculated by measuring a cycle of signal from the engine speed sensor 702 (step "S103").

Figure 10:
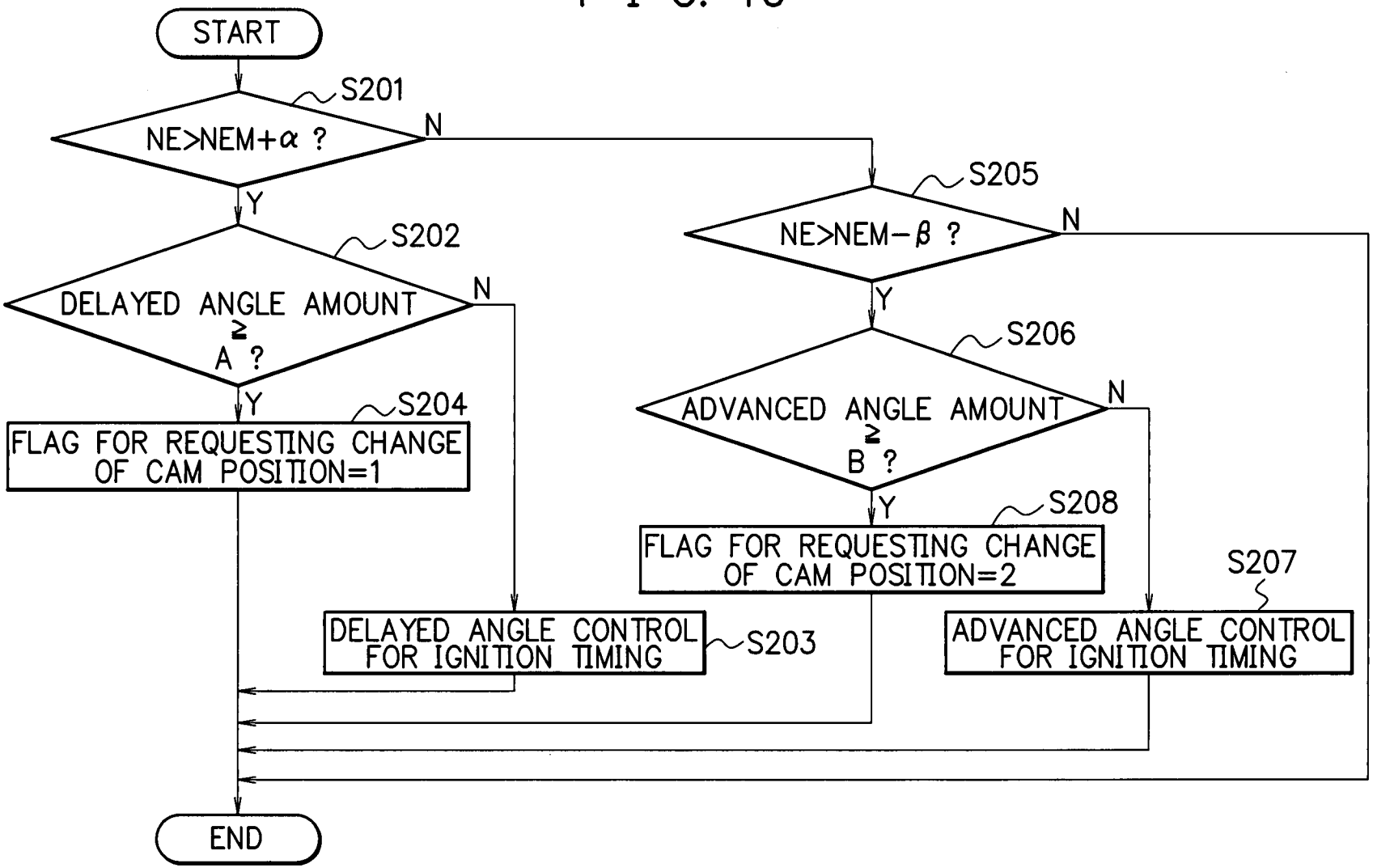
FIG. 10 is a flow chart for explaining a processing operation of an advanced angle adjustment or a delayed angle adjustment for an ignition timing.

When the engine is determined to be in the idling state in the step "S102", an adjustment of an advanced angle or the delayed angle for the ignition timing is made by the idling-state target engine speed calculating unit 56, and the ignition timing adjusting unit 57 as shown in a flow chart in FIG. 10. As shown in FIG. 10, in the case that the actual engine speed NE is larger than a target engine speed NEM, exceeding an acceptable amount a (step "S201".), under the condition that the delayed angle amount by now does not reach the delayed angle limited amount "A" (step "S202"), the engine speed is corrected by delaying the ignition timing (step "S203"). If the delayed angle amount by now is reaches the delayed angle limited amount "A" (step "S202"), the ignition timing is not made delayed and a flag "1(one)" is set, which signifies that the cam position needs to be changed in the direction for decreasing the lift amount (step "S204").

Meanwhile, in the case that the actual engine speed NE is smaller than the target engine speed NEM, less than an acceptable amount β(step "S205"), under the condition that the advanced angle amount by now does not reach the advanced angle limited amount "B" (step "S206"), the engine speed is corrected by advancing the ignition timing (step "S207"). If the advanced angle amount by now reaches the advanced angle limited amount "B" (step "S206"), the ignition timing is not made advanced and a flag "2(two)" is set, which signifies that the cam position needs to be changed in the direction for increasing the lift amount (step "S208").

Note that the actual engine speed NE is within the range of acceptable values α, and β (step "S201", step "S205"), the processing is made to end there.

Figure 12:
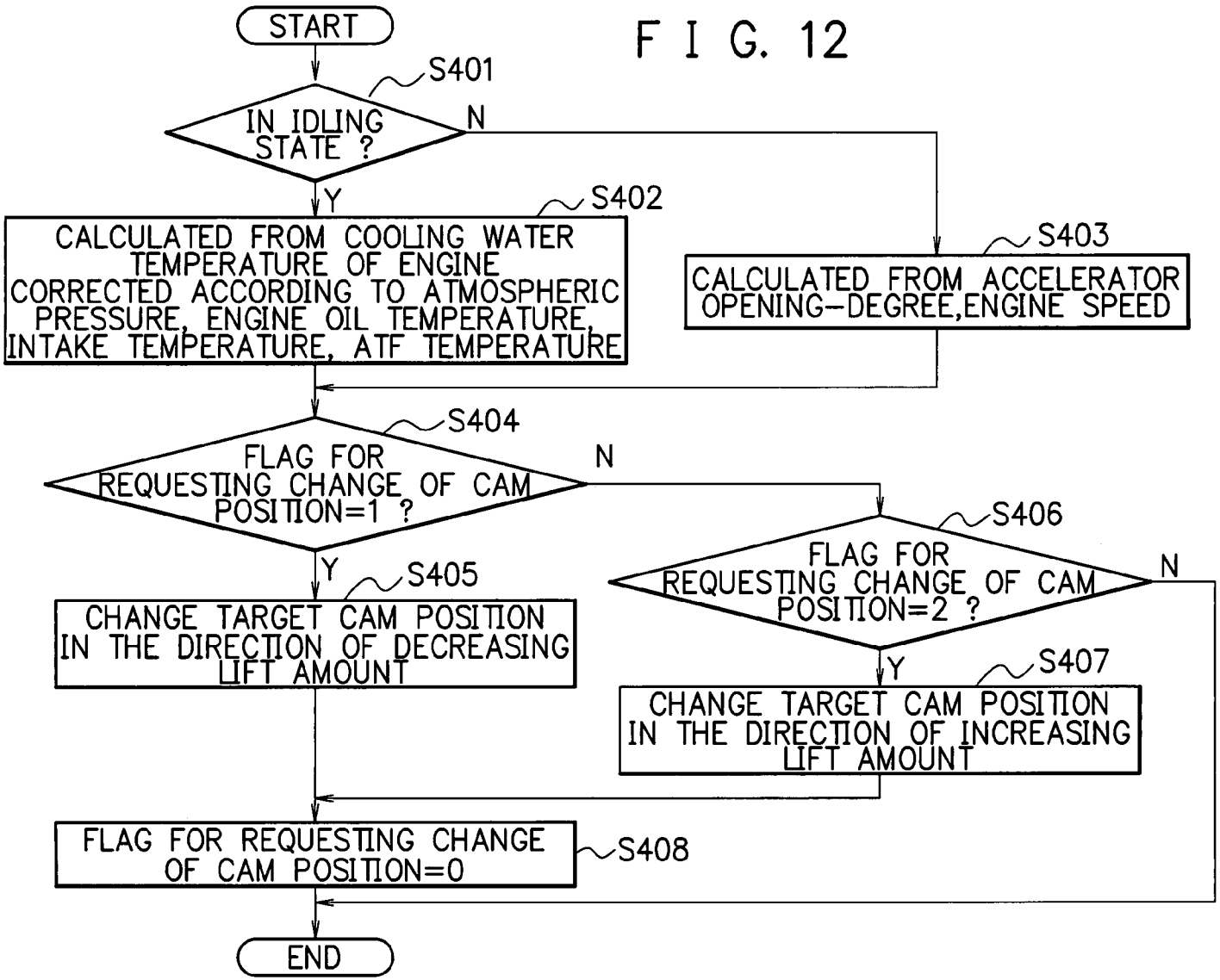
FIG. 12 is a flow chart for explaining a calculating processing for a target cam position.

To return to the explanation of the flow chart in FIG. 9, the target cam position is calculated by the target cam position calculating unit 52, as shown in a flow chart in FIG. 12.

In FIG. 12, a detailed flow chart for a processing for calculating the target cam position in the above described step "S104" is shown. As shown in FIG. 12, when the engine is determined to be in the idling state (step "S401"), the target cam position is calculated based on the cooling water temperature, and the target cam position is corrected based on the atmospheric pressure, the engine oil temperature, the ATF temperature, and the intake temperature (step "S402"). For example, when the cooling water temperature is low, the target cam position is calculated so as to enlarge the lift amount for increasing the intake amount (in examples of FIG. 5 and FIG. 6, the cam portion 13$b_1$ which is higher in cam position will be the target). Further, when the atmospheric pressure, the engine temperature, the ATF temperature or intake temperature are low, the target cam position is corrected so as to increase the lift amount.

Next, in the processing of the advanced angle or delayed angle adjustment for the ignition timing as shown in FIG. 10, whether a flag for requesting the change of cam position is set or not is determined, if the flag for requesting the change of cam position is set as "1(one)"(step "S404"), the target cam position is corrected so as to change the cam position in the direction of decreasing the lift amount (step "S405").

If the flag for requesting the change of cam position is set as "2(two)"(step "S406"), the target cam position is corrected so as to change the cam position in the direction of increasing the lift amount (step "S407"). After that, the flag for requesting the change of cam position is reset as "0(zero)" (step "S408") and the processing is made to end.

Meanwhile, when the engine is determined to be not in the idling state (step "S401"), the target cam position is calculated according to the accelerator opening-degree and the engine speed. In the case that engine is not in the idling state, the advanced angle or delayed angle adjustment for the ignition timing is not performed. Therefore, the flag for requesting the change of cam position remains "0(zero)".

To return to the flow chart in FIG. 9, the deviation between the target cam position finally determined in the above described step "S104" and the actual cam position detected in the above described step "S101" is calculated by the deviation calculating unit 54 (step "S105"), and the control amount of feedback corresponding to the deviation is also calculated by the control amount calculating unit 55 (step "S106"). In the present embodiment, a PI (proportional integral) control amount in which deviation is accumulated is calculated, however, other calculating methods are also acceptable.

The acceleration motor 44 is controlled based on the control amount of feedback thus calculated, so that the cam 13 is allowed to slide to the target cam position (step "S107").

According to the control device for engine described above, when the engine is determined to be in the idling state, the target cam position is calculated based on the temperature condition of the engine unit 1 (cooling water temperature), and the calculated target cam position is corrected according to the atmospheric pressure, the engine oil temperature, the ATF temperature, the intake temperature, so that a fluctuation of the intake amount of air in the idling state is suppressed, as a result, the engine rotation can be stabilized, preventing the engine rotation from being revved up or being stalled.

Additionally, if the device determines there exists the unacceptable difference between the target engine speed and the actual engine speed in the idling state, the advanced angle or delayed angle adjustment for ignition timing is performed, so that a hunting in the engine rotation can be prevented when controlling the intake amount of air. In this case, when the required advanced angle amount (or delayed angle amount) exceeds the predetermined limited amount "B" (or "A"), the advanced angle or delayed angle adjustment for the ignition timing is not made, and the target cam position is corrected so as to increase (or decrease) the lift amount in the idling state, so that the ignition timing is not advanced (or delayed) excessively, as a result, the fluctuation of output, namely, the fluctuation of the exhaust gas can be reduced.

Furthermore, in addition to the control explained in the above embodiment, the processing cycle in which the cam 13 is slid by calculating the target cam position in the idling state is made to be longer than the processing cycle in which the cam 13 is slid by calculating the target cam position not in the idling state, or the speed at which the cam 13 is slid in the idling state is made to be slower than the speed at which the cam 13 is slid not in the idling state, so that a variation ratio of combustion state in the idling state is not so excessive, as a result, the fluctuation of engine speed can be reduced. And the amount of variation in the target cam position, namely, the amount of variation in the valve lift amount in the idling state may be controlled so as not to exceed the fixed amount.

The cam position in the idling state may be stored, correlated with the engine temperature condition at that time, and the cam position thus stored can be utilized at the next time of the same or similar condition of temperature. Thereby, load for calculating processing in the control device 50 can be reduced. When the case described above is compared with the case that the predetermined correlation between the cam position and the engine temperature condition is applied to the same type of engine uniformly, the optimal position for each engine is determined in the case described above, so that the influence by an individual difference of engine happened in manufacturing process can be abated, and the mechanical loss of engine can be reduced.

The present invention is described with the various embodiments thus far, but the present invention is not limited to only these embodiments, and modifications and the like can be made within the scope of the present invention. In the above embodiment, the example that the present invention is applied to the engine of a motorcycle is explained, but the present invention is also efficiently applicable to the engine of a four-wheeled automobile or the like. When the present invention is applied to the four-wheeled automobile etc., the condition whether the center stand 124 is in use or not (step "S305") in the processing for determining the idling state explained in the flow chart of FIG. 11 should be left out.

It goes without saying that the control device 50 in the above embodiment can be attained the object by a computer (CPU or MPU and the like) reading out a program stored in a storage medium. In this case, respective functions explained in the above embodiments are realized by the program read out from the storage medium, namely, the program itself constitutes the present invention. As the storage medium for supplying the program, ROM, a floppy disk, a hard disk, an optical disk, a magneto-optical disk, CD-ROM, CD-R, a magnetic tape, and a nonvolatile memory card and the like can be utilized.

The control device of the above-mentioned embodiment may be composed of CPU, MPU, RAM, ROM, or the like in a computer, and realized by operating a program stored in the RAM or ROM, wherein this program is included in the embodiment of the present invention. It may also be realized by recording the program that operates the computer to function as described above, in a record medium such as a CD-ROM to be read by the computer, wherein this record medium recorded with the program therein is included in the embodiment of the present invention. Such a program product as the computer-readable record medium or the like recorded therein with the program may also be applied to the embodiment of the present invention. This program, record medium, transmission medium (internet and the like transmitting the program), and program product are included in the scope of the present invention.

As explained thus far, according to the present invention, when the engine is determined to be in the idling state, the target cam position is calculated based on the condition of engine temperature, and the target cam position is corrected according to the atmospheric pressure, the temperature of engine oil, the temperature of automatic transmission fluid, the intake temperature and the like, so that the fluctuation of the intake amount of air in the idling state is suppressed, as a result, the engine rotation can be stabilized, preventing the engine rotation from being revved up fast or being stalled.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A control device for an engine provided with a valve driving mechanism in which a cam having its cam profile axially varying continuously is slid along the axis of the cam shaft to control continuously a valve lift characteristic to be steplessly variable, comprising:

a control unit sliding the cam by controlling a cam position moving unit for sliding the cam;

an idling-state determining unit determining whether the engine is in an idling state or not; and a target cam position calculating unit calculating the target cam position based on the engine temperature condition, and the target cam position is corrected according to other information when the engine is in the idling state by the idling-state determining unit.

2. The control device for the engine according to claim 1 used in engines of motorcycles, wherein the idling-state determining unit determines the engine to be in the idling state when both conditions that an accelerator is shut down completely, and also any of the conditions that a vehicle speed is "0(zero)", that a transmission is in a neutral position, that a clutch is disconnected, that a center stand is in use are realized together.

3. The control device for the engine according to claim 1, further comprising:

an ignition timing adjusting unit making an advanced angle adjustment or a delayed angle adjustment for the ignition timing when there exists an unacceptable difference between the target engine speed and the actual engine speed, when the engine is determined to be in the idling state by the idling-state determining unit.

4. The control device for the engine according to claim 3, further comprising:

a target cam position correcting unit correcting the target cam position in the idling state calculated by the target cam position calculating unit, not making the advanced angle adjustment or the delayed angle adjustment for the ignition timing, when an advanced angle amount or delayed angle amount required for the advanced angle or the delayed angle adjustment for the ignition timing by the ignition timing adjustment unit exceeds the predetermined limited amount.

5. The control device for the engine according to claim 1, wherein the target cam position calculating unit determines the target cam position based on an accelerator opening-degree, when the engine is determined not to be in the idling state.

6. The control device for the engine according to claim 1, wherein the cam includes a principal cam surface with an idling-state cam surface attached thereto, and the target cam position calculating unit determines the target cam position in the idling state within a range of the idling-state cam surface.

7. The control device for the engine according to claim 1, further comprising:

a storing unit storing the cam position in the idling state, correlating with the engine temperature condition at that time.

8. The control device for the engine according to claim 1, wherein the processing cycle in which the cam is slid by calculating the target cam position in the idling state is made longer than the processing cycle in which cam is slid by calculating the target cam position not in the idling state.

9. The control device for the engine according to claim 1, wherein the speed in which the cam is slid to the target cam position in the idling state is made slower than the speed in which the cam is slid to the target cam position not in the idling state.

10. The control device for the engine according to claim 1, wherein a cooling water temperature of the engine is detected as the engine temperature condition.

11. The control device for the engine according to claim 1, wherein the other information includes at least one information among atmospheric pressure, an engine oil temperature, an automatic transmission fluid temperature, and an intake temperature.

12. The control device for the engine according to claim 1, wherein a fuel injector is provided on the downstream side of an intake port of a cylinder head with being directed to the periphery of an umbrella portion of the intake valve, controlling the control device to spray the fuel balancing with an intake amount.

13. A control program recorded on a computer readable medium product for controlling an engine comprising a valve driving mechanism in which a cam having its cam profile axially varying continuously is slid along the axis of the cam shaft to control continuously a valve lift characteristic to be steplessly variable, said control program product comprising the steps of:

sliding the cam by controlling a cam position moving unit for sliding the cam;

determining whether the engine is in an idling state or not;

calculating a target cam position based on the engine temperature condition; and correcting the target cam position according to other information when the engine is in the idling state.

* * * * *